US010685775B2

(12) United States Patent
Jung et al.

(10) Patent No.: US 10,685,775 B2
(45) Date of Patent: Jun. 16, 2020

(54) COIL COMPONENT

(71) Applicant: SAMSUNG ELECTRO-MECHANICS CO., LTD., Suwon-Si, Gyeonggi-Do (KR)

(72) Inventors: Min Ki Jung, Suwon-Si (KR); Su Bong Jang, Suwon-Si (KR); Jae Woon Park, Suwon-Si (KR); Seung Jae Song, Suwon-Si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 16/004,045

(22) Filed: Jun. 8, 2018

(65) Prior Publication Data

US 2019/0156987 A1 May 23, 2019

(30) Foreign Application Priority Data

Nov. 22, 2017 (KR) ..... 10-2017-0156355

(51) Int. Cl.
*H01F 27/28* (2006.01)
*H01F 27/29* (2006.01)
*H01F 17/00* (2006.01)

(52) U.S. Cl.
CPC ..... *H01F 27/2804* (2013.01); *H01F 17/0013* (2013.01); *H01F 27/29* (2013.01); *H01F 27/292* (2013.01); *H01F 2027/2809* (2013.01)

(58) Field of Classification Search
CPC ..... H01F 27/2804; H01F 2027/2809; H01F 27/29
USPC ..... 336/200, 232
See application file for complete search history.

(56) References Cited

U.S. PATENT DOCUMENTS

| | | | | |
|---|---|---|---|---|
| 6,154,114 | A | 11/2000 | Takahashi | |
| 2012/0274435 | A1* | 11/2012 | Jeong | H01F 17/0033 336/200 |
| 2016/0248397 | A1* | 8/2016 | Ishizuka | H03H 7/38 |
| 2019/0051440 | A1* | 2/2019 | Ueki | H01F 19/04 |

FOREIGN PATENT DOCUMENTS

| | | | |
|---|---|---|---|
| JP | 2002-100520 | A | 4/2002 |
| JP | 3457371 | B2 | 10/2003 |
| KR | 10-0534169 | B1 | 12/2005 |

* cited by examiner

*Primary Examiner* — Tszfung J Chan
(74) *Attorney, Agent, or Firm* — Morgan, Lewis & Bockius LLP

(57) ABSTRACT

A coil component includes a body part including an internal coil including one end and another end; a first external electrode connected to the one end of the internal coil; a second external electrode connected to the another end of the internal coil; and a third external electrode connected to a first point between the one end of the internal coil and the another end of the internal coil.

18 Claims, 12 Drawing Sheets

COIL COMPONENT

CROSS-REFERENCE TO RELATED APPLICATION(S)

This application claims benefit of priority to Korean Patent Application No. 10-2017-0156355 filed on Nov. 22, 2017 in the Korean Intellectual Property Office, the disclosure of which is incorporated herein by reference in its entirety.

TECHNICAL FIELD

The present disclosure relates to a coil component.

BACKGROUND

An inductor, a coil component, is a representative passive element constituting an electronic circuit together with a resistor and a capacitor. As an electronic device on which an electronic circuit is formed is miniaturized, it is necessary for the coil component, for example, an inductor, to also be miniaturized.

Accordingly, a chip inductor formed using a lamination method is recently developed. Such a laminated inductor is required to be usable at a high frequency of 100 MHz or more, due mainly to a self resonance frequency (SRF) of a high frequency band and low specific resistance.

In addition, in order to reduce loss in a frequency of a device, high quality factor Q characteristics are required, and the possibility of adjusting inductance is also required. Accordingly, it is necessary to optimize a shape and a structure of a coil of the coil component capable of finely adjusting inductance while satisfying high Q characteristics.

SUMMARY

An aspect of the present disclosure may provide a coil component which may satisfy high Q characteristics and may easily adjust inductance.

According to an aspect of the present disclosure, a coil component may include a body part including an internal coil including one end and another end; a first external electrode connected to the one end of the internal coil; a second external electrode connected to the another end of the internal coil; and a third external electrode connected to a first point between the one end of the internal coil and the other end of the internal coil.

According to another aspect of the present disclosure, a coil component may include a body part including an internal coil including a plurality of coil patterns formed on a plurality of body sheets, respectively, and one or more via electrodes penetrating through insulating layers disposed between the plurality of body sheets; a first end electrode connected to one end of the internal coil; a second end electrode connected to another end of the internal coil; and at least one intermediate node external electrode connected to at least one point of the internal coil.

In the summary, all of features of the present disclosure are not mentioned. Various units for solving an object of the present disclosure may be understood in more detail with reference to specific exemplary embodiments of the following detailed description.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Here, a coil component according to an exemplary embodiment in the present disclosure, particularly, a high frequency inductor will be described.

The coil component according to an exemplary embodiment in the present disclosure may have three or more connection ports, that is, external electrodes. Therefore, connections of the ports to the coil component may be variously combined, and various inductance values may be provided by one coil component accordingly.

Here, various examples of the coil component according to an exemplary embodiment in the present disclosure will be described with reference to the accompanying drawings.

Examples illustrated in FIGS. 1 through 4 relate to exemplary embodiments for the coil component including three connection ports, that is, three external terminals.

Figure 1:
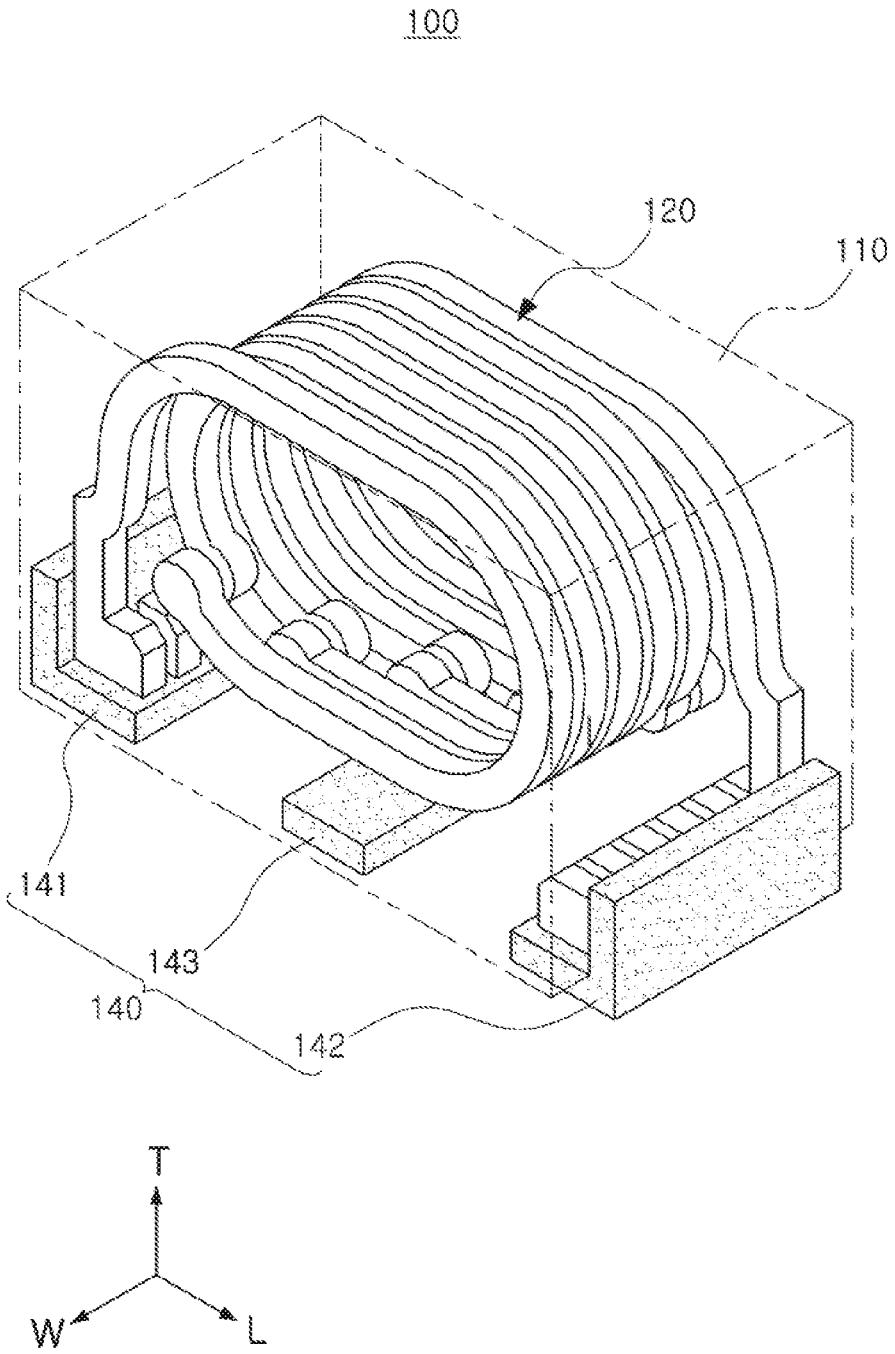
FIG. 1 is a perspective view illustrating one example of a coil component according to an exemplary embodiment in the present disclosure.
Figure 2:
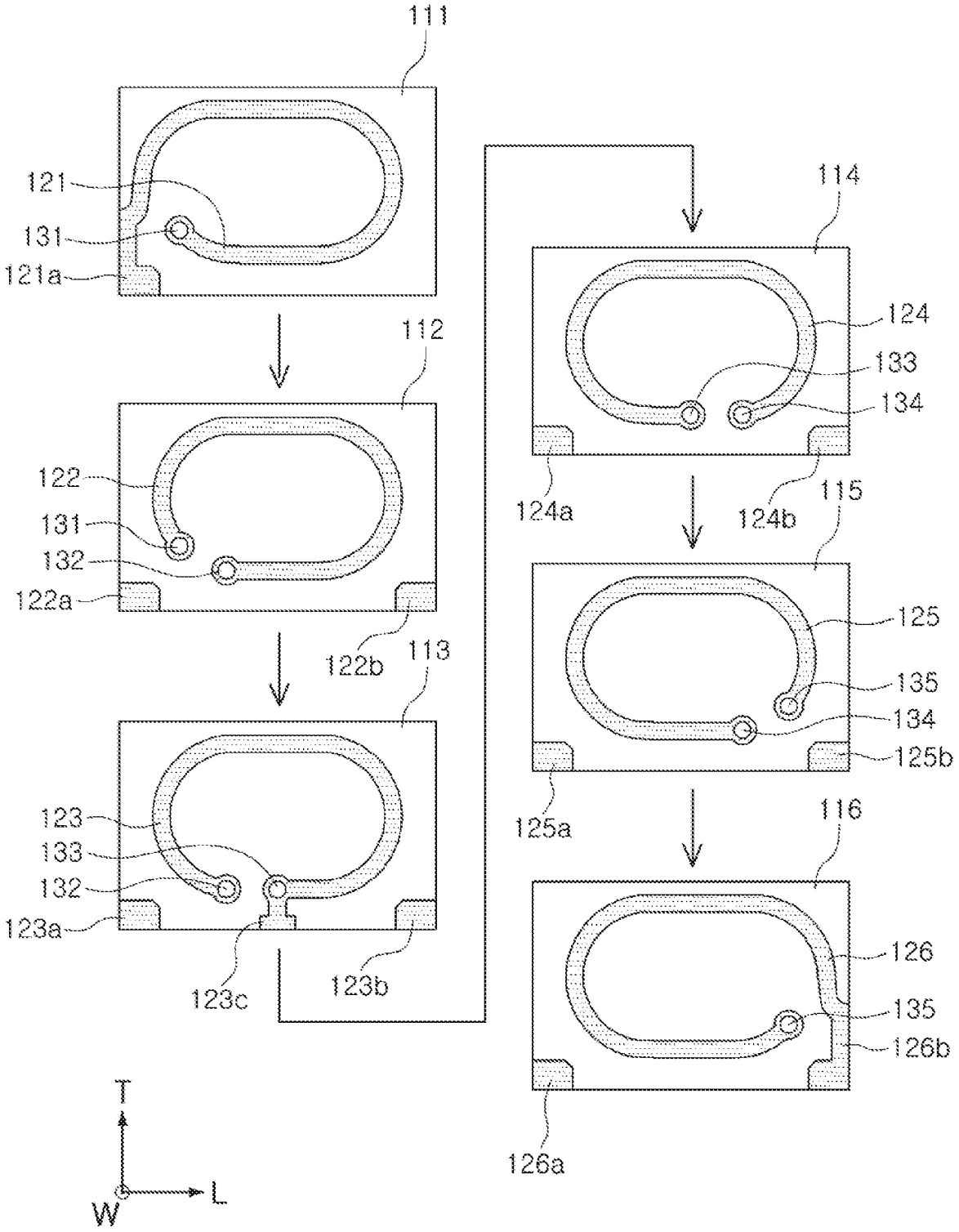
FIG. 2 is a front view of a plurality of body sheets included in the coil component illustrated in FIG. 1.
Figure 3:
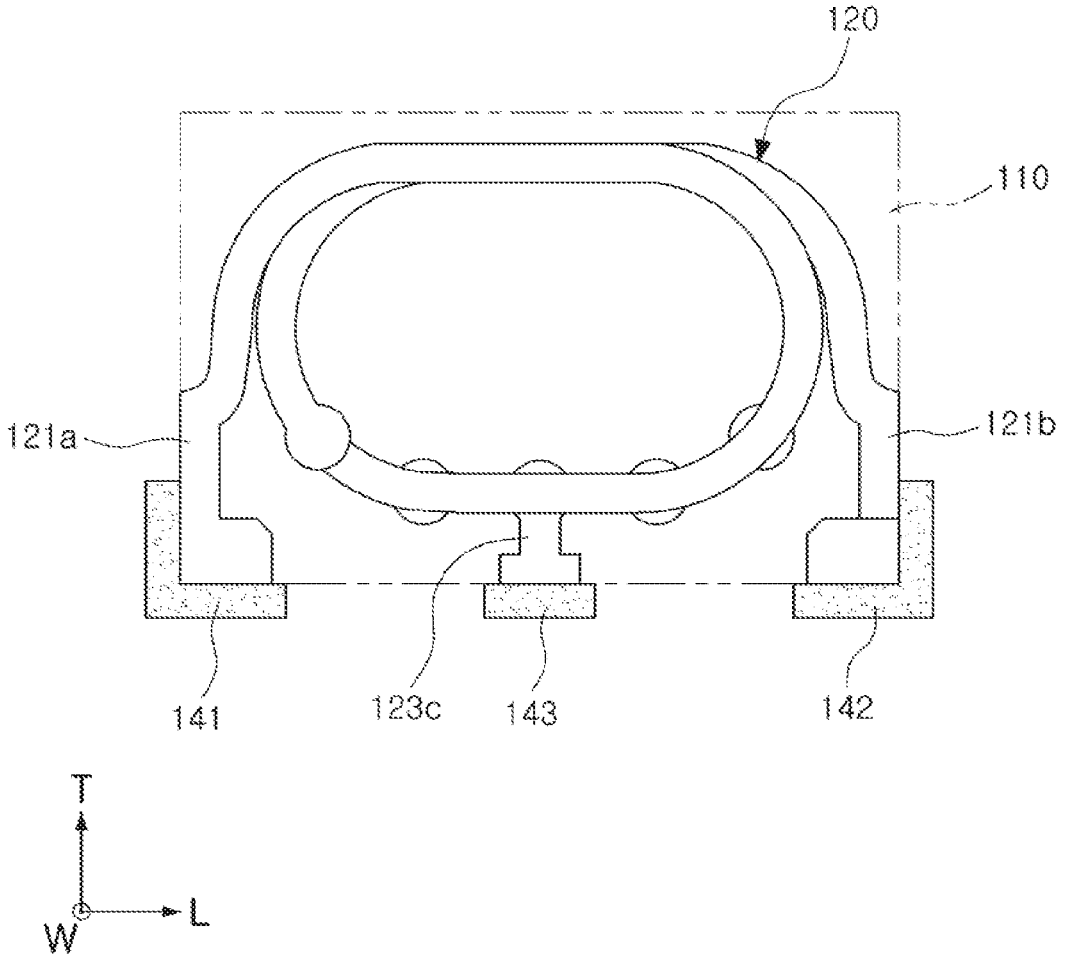
FIG. 3 is a front view of the coil component illustrated in FIG. 1.
Figure 4:
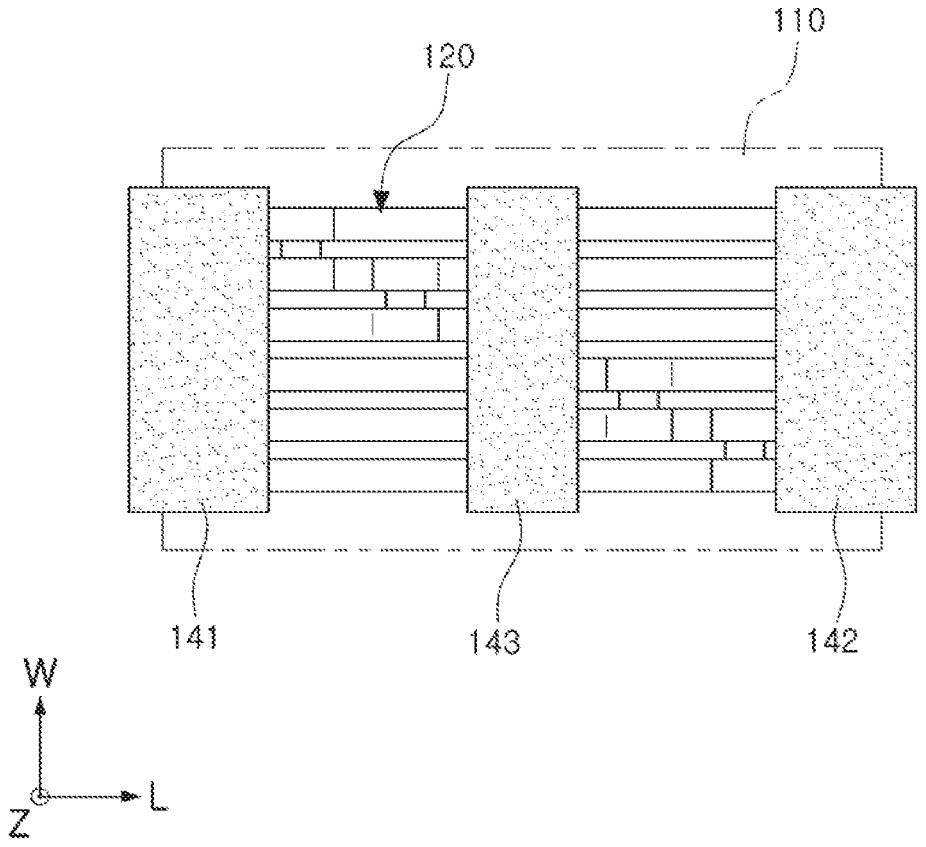
FIG. 4 is a bottom view of the coil component illustrated in FIG. 1.

FIG. 1 is a perspective view illustrating one example of such a coil component. FIG. 2 is a front view of a plurality of body sheets included in the coil component illustrated in FIG. 1. FIG. 3 is a front view of the coil component illustrated in FIG. 1. FIG. 4 is a bottom view of the coil component illustrated in FIG. 1.

Referring to FIGS. 1 through 4, a coil component 100 may include a body part 110 and a plurality of external electrodes 140.

The body part 110 may substantially determine an outer shape of the coil component. The body part 110 may include an upper surface and a lower surface opposing each other in a thickness T direction thereof, a first end surface and a second end surface opposing each other in a length L direction thereof, and a front surface and a rear surface opposing each other in a width W direction thereof. The body part 110 may have a hexahedral shape as in the illustrated example, but is not limited thereto.

A material forming the body part 110 may be appropriately selected by those skilled in the art in consideration of characteristics to be implemented by the coil component. For example, in a case in which the coil component 100 is applied to a high frequency inductor, a ceramic powder, or the like may be used so that a closed magnetic path is easily formed using a dielectric material.

According to the present exemplary embodiment, a manufacturing method configuring the body part 110 is not particularly limited. Various methods may be used as the manufacturing method configuring the body part 110. For example, a stacking method for stacking a plurality of dielectric sheets, disposing a conductive material for an internal coil on each of the sheets, and then connecting the sheets to each other through a via may be used. Alternatively, as another example, a method for encapsulating and embodying an internal coil of a spiral shape which is manufactured in advance with a dielectric material or the like may also be used.

Here, an example in which the body part 110 is formed by stacking a plurality of body sheets 111 to 116 will be described, but the body part 110 may also be formed by the method for encapsulating and embodying the internal coil of the spiral shape which is manufactured in advance with the dielectric material or the like.

The body part 110 may include an internal coil 120. The central axis of the internal coil 120 may be formed in a horizontal direction with respect to a mounting surface of the body part—a surface on which the coil component is mounted when the coil component is mounted on a printed circuit board—, that is, a lower surface of the body part 110 in the illustrated example. As illustrated, the internal coil 120 may be wound around a horizontal direction with respect to the mounting surface. Accordingly, an influence between the mounting surface and a magnetic field generated in an inductor may be significantly reduced. Accordingly, an influence on inductance may be significantly reduced.

The internal coil 120 may be wound while having both ends, that is, one end and the other end. The one end and the other end of the internal coil 120 may be connected to first and second external electrodes 141 and 142, respectively. Since the first and second external electrodes 141 and 142 are connected to both ends of the internal coil 120, respectively, the first and second external electrodes 141 and 142 may be referred to as end electrodes.

In addition, one point between both ends of the intern coil 120 may be connected to another external electrode 143. The external electrode 143 connected to one point which is not an end of the internal coil 120 may be referred to as an intermediate node external electrode.

As an example, as illustrated, the internal coil 120 may include a plurality of coil patterns 121 to 126 formed on each of the plurality of body sheets 111 to 116, and one or more via electrodes 131 to 135 penetrating through insulating layers (not shown) disposed between the plurality of body sheets 111 to 116.

In addition, the internal coil 120 may include internal electrode patterns formed between the internal coil and external electrodes. For example, the internal coil 120 may include a first internal electrode pattern 121*a* connected to the one end of the internal coil and a first external electrode 141, a second internal electrode pattern 126*b* connected to the other end of the internal coil and a second external electrode 142, and a third internal electrode pattern 123*c* connected to a first point of the internal coil and a third external electrode 143.

Therefore, both ends of the internal coil 120 may be connected to the first and second external electrodes 141 and 142, respectively, through the first and second internal electrode patterns 121*a* and 121*b*, and the first point of the internal coil may be connected to the third external electrode 143 through the third internal electrode pattern 123*c*. By such internal electrode patterns, contact reliability between the internal coil 120 and the external electrodes may be increased.

Some body sheets 112, 113, 114, 115, and 116 may further include dummy patterns 122*a*, 122*b*, 123*a*, 123*b*, 124*a*, 124*b*, 125*a*, 125*b*, and 126*a*. The dummy patterns 122*a*, 122*b*, 123*a*, 123*b*, 124*a*, 124*b*, 125*a*, 125*b*, and 126*a* may be connected to one of the first and second external electrodes 141 and 142 and may not physically contact with the corresponding coil patterns disposed on the same body sheets. However, the dummy patterns may not be formed or may be variously modified according to exemplary embodiments.

As an example, the first external electrode 141 may be formed on a first side portion of the lower surface of the body part adjacent to the first end surface of the body part in the illustrated example, a left side portion of the lower surface of the body part adjacent to a left end surface of the body part, and the second external electrode 142 may be formed on a second side portion of the lower surface of the body part adjacent to a second end surface of the body part in the illustrated example, a right side portion of the lower surface of the body part adjacent to a right end surface of the body part. The third external electrode pattern 143 may be formed on a central portion of the lower surface of the body part.

In the illustrated example, the first and second external electrodes 141 and 142 may be formed in a shape similar to an alphabet L letter. By forming the external electrodes in the shape of L letter, a contact area between the external electrodes and a contact means on the mounting surface may be increased.

Meanwhile, examples illustrated in FIGS. 5 through 8 relate to exemplary embodiments for the coil component including four connection ports, that is, four external terminals.

Figure 5:
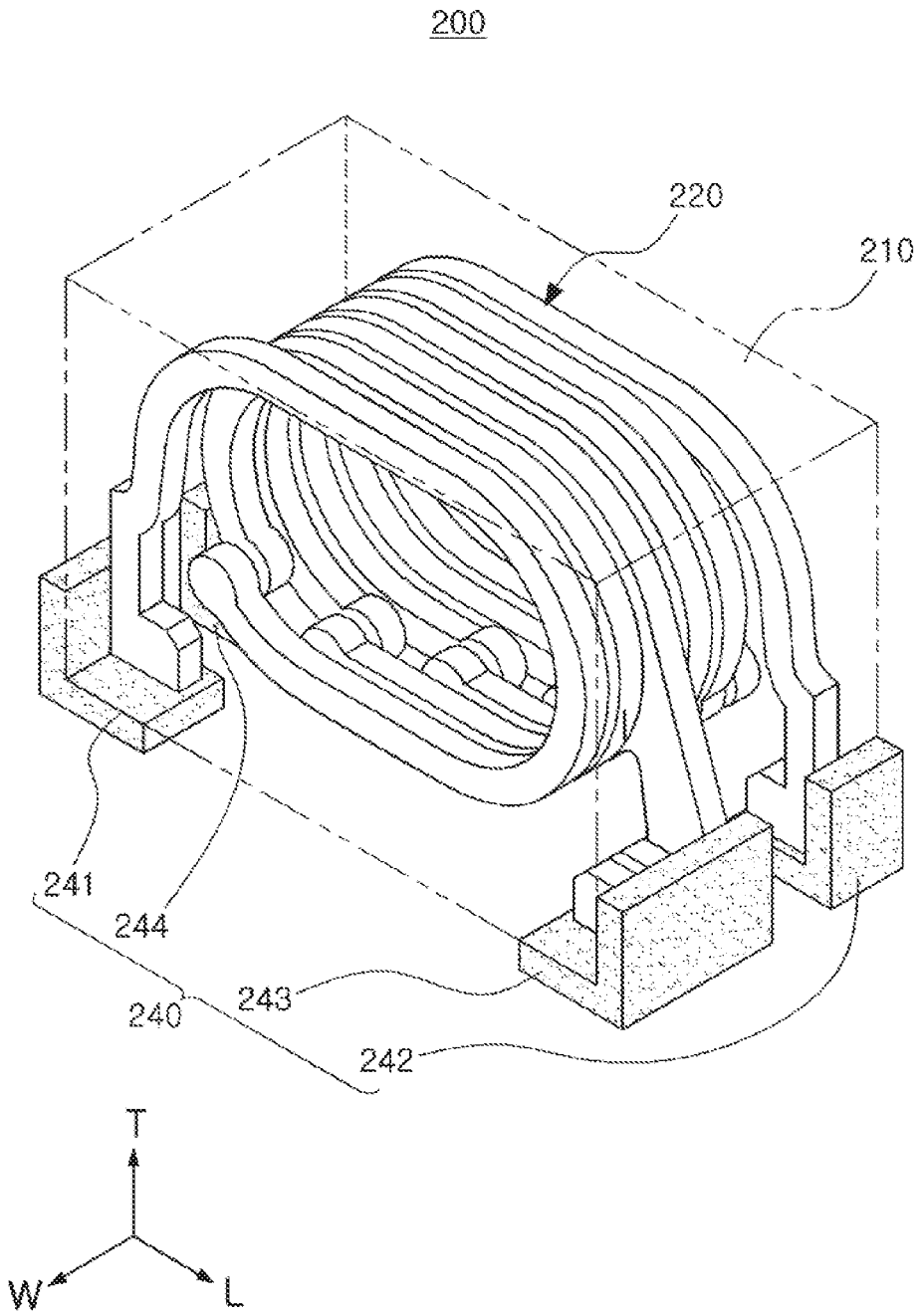
FIG. 5 is a perspective view illustrating another example of a coil component according to an exemplary embodiment in the present disclosure.
Figure 6:
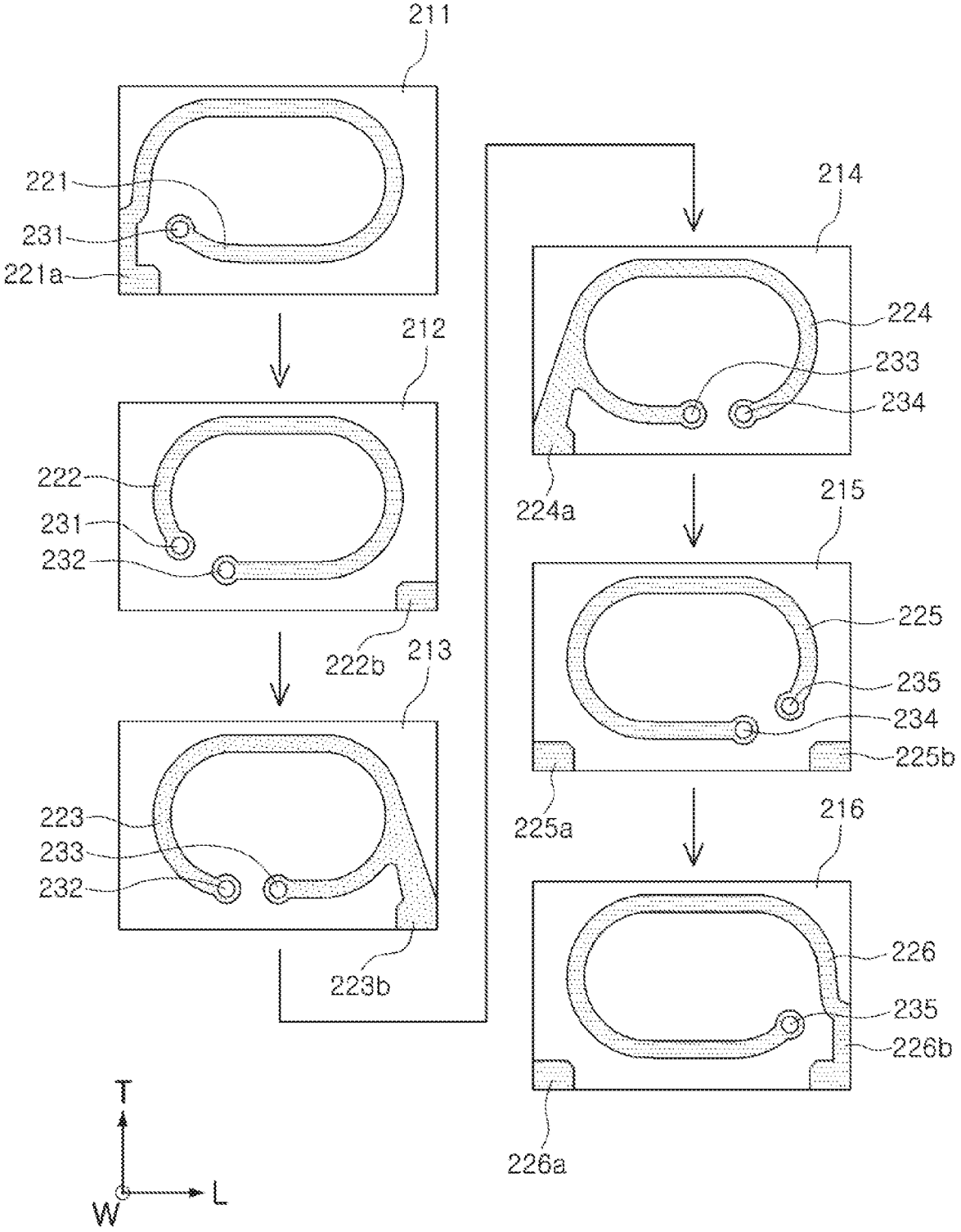
FIG. 6 is a front view of a plurality of body sheets included in the coil component illustrated in FIG. 5.
Figure 7:
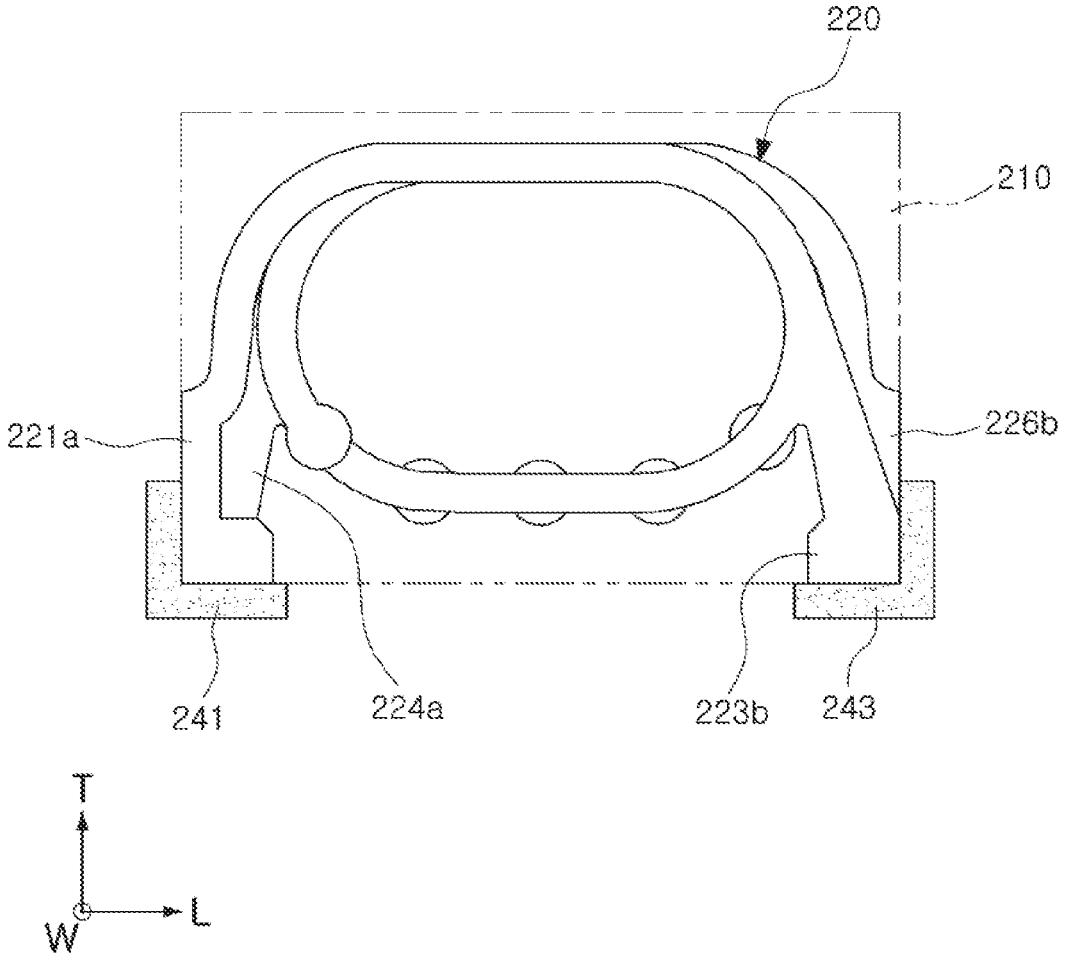
FIG. 7 is a front view of the coil component illustrated in FIG. 5.
Figure 8:
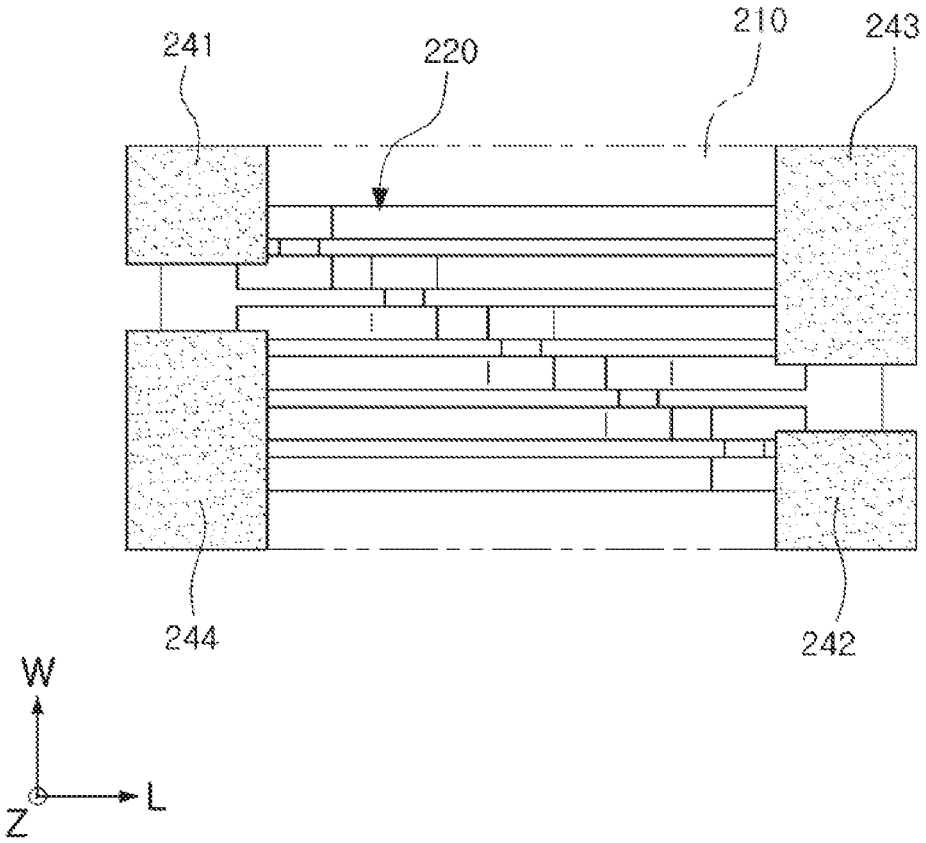
FIG. 8 is a bottom view of the coil component illustrated in FIG. 5.

FIG. 5 is a perspective view illustrating one example of such a coil component. FIG. 6 is a front view of a plurality of body sheets included in the coil component illustrated in FIG. 5. FIG. 7 is a front view of the coil component illustrated in FIG. 5. FIG. 8 is a bottom view of the coil component illustrated in FIG. 5.

Hereinafter, the description overlapping with the description described above with reference to FIGS. 1 through 4 will be omitted for convenience of explanation.

Referring to FIGS. 5 through 8, a coil component 200 may include a body part 210 including an internal coil 220 having the one end and the other end.

A first external electrode 241 may be connected to the one end of the internal coil 220 and a second external coil 242 may be connected to the other end of the internal coil 220.

A third external electrode 243 may be connected to a first point between the one end and the other end of the internal coil 220, and a fourth external electrode 244 may be connected to a second point between the first point and the other end of the internal coil.

For example, the internal coil 220 may include a plurality of coil patterns 221 to 226 formed on a plurality of body sheets 211 to 216, respectively, one or more via electrodes 231 to 235 penetrating through insulating layers disposed between the plurality of body sheets, a first internal electrode pattern 221*a* connected to the one end of the internal coil and the first external electrode 241, a second internal electrode pattern 226*b* connected to the other end of the internal coil and the second external electrode 242, a third internal electrode pattern 223*b* connected to the first point of the internal coil and the third external electrode 243, and a fourth internal electrode pattern 224*a* connected to the second point of the internal coil and the fourth external electrode 244.

The first external electrode 241 and the fourth external electrode 244 may be formed to be spaced apart from each other on a first side portion of the lower surface of the body part adjacent to the first end surface of the body part—in the illustrated example, a left side portion of the lower surface of the body part adjacent to a left end surface of the body part. The second external electrode 242 and the third external electrode 243 may be formed to be spaced apart from each other on a second side portion of the lower surface of the body part adjacent to the second end surface of the body part—in the illustrated example, a right side portion of the lower surface of the body part adjacent to a right end surface of the body part.

Some body sheets 212, 215, and 216 may further include dummy patterns 222*b*, 225*a*, 225*b*, and 226*a*. The dummy patterns 222*b*, 225*a*, 225*b*, and 226*a* may be connected to one of the first to fourth external electrodes 241 to 244 and may not physically contact with the corresponding coil patterns disposed on the same body sheets. However, the dummy patterns may not be formed or may be variously modified according to exemplary embodiments.

Meanwhile, examples illustrated in FIGS. 9 through 12 relate to exemplary embodiments for the coil component including five connection ports, that is, five external terminals.

Figure 9:
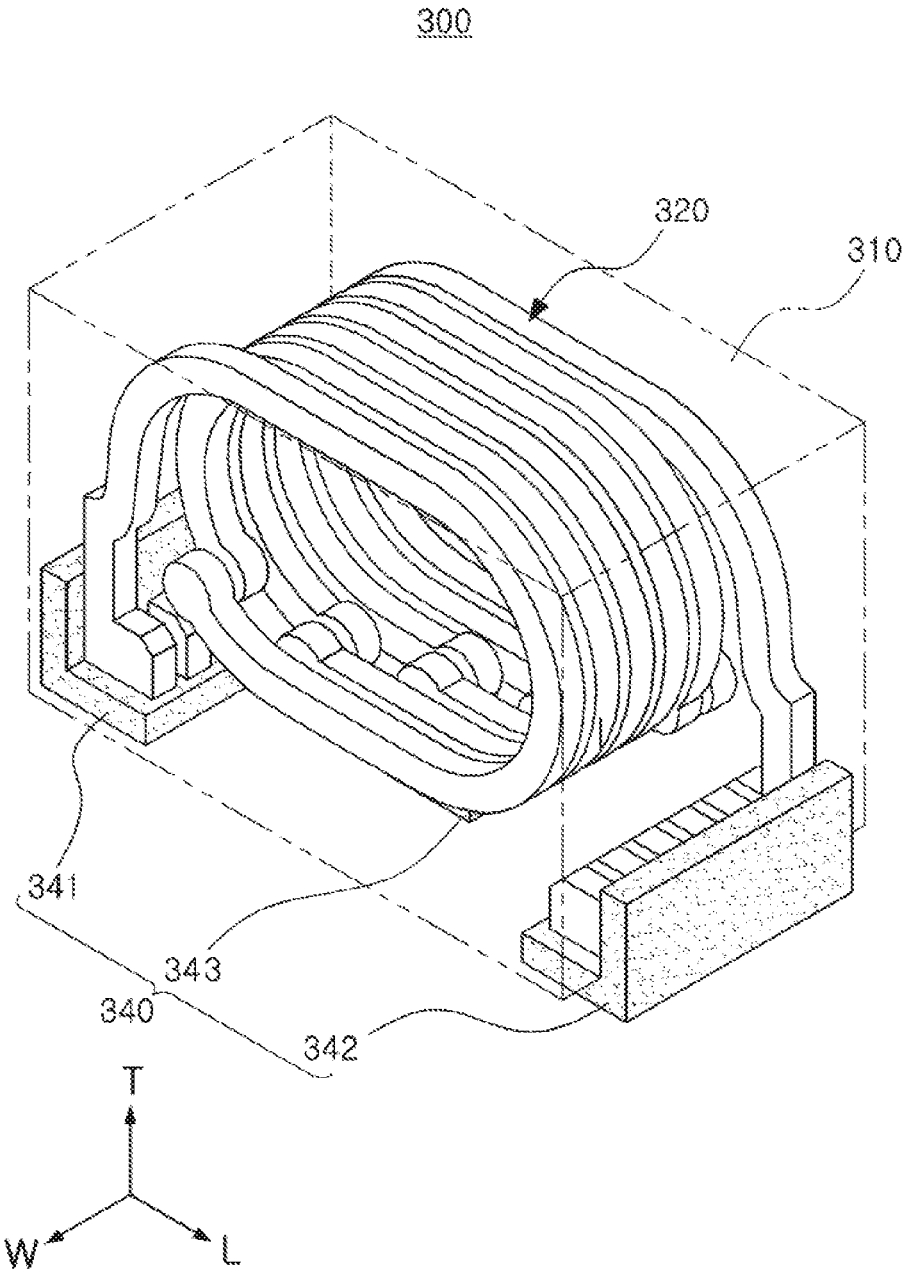
FIG. 9 is a perspective view illustrating another example of a coil component according to an exemplary embodiment in the present disclosure.
Figure 10:
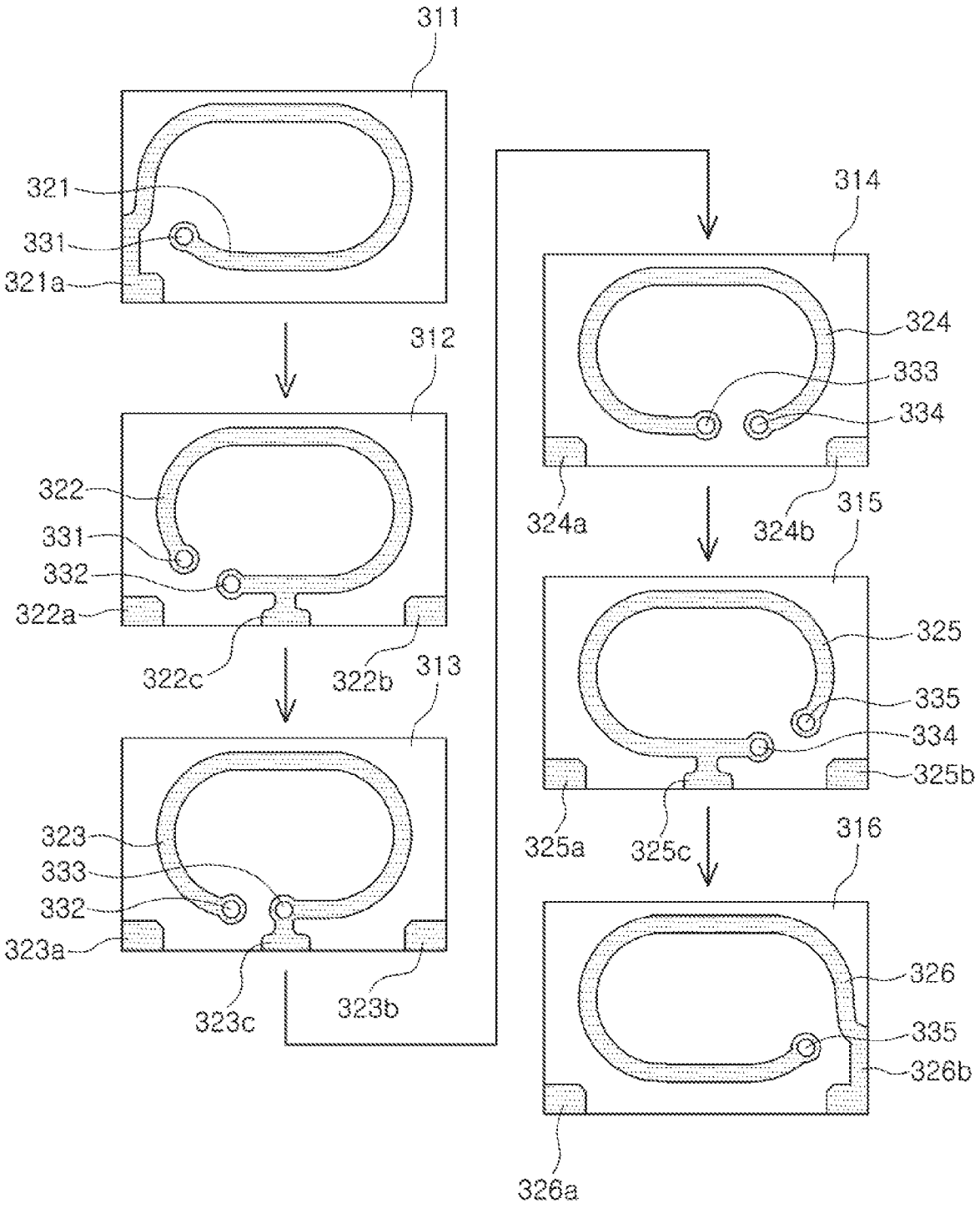
FIG. 10 is a front view of a plurality of body sheets included in the coil component illustrated in FIG. 9.
Figure 11:
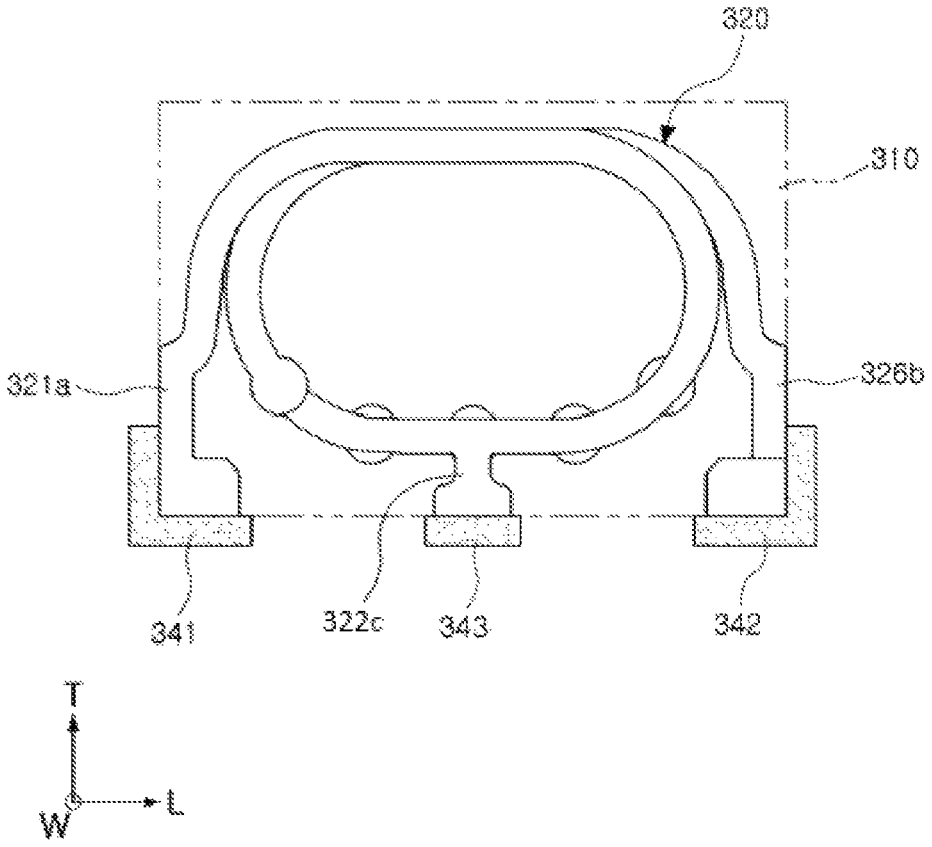
FIG. 11 is a front view of the coil component illustrated in FIG. 9.
Figure 12:
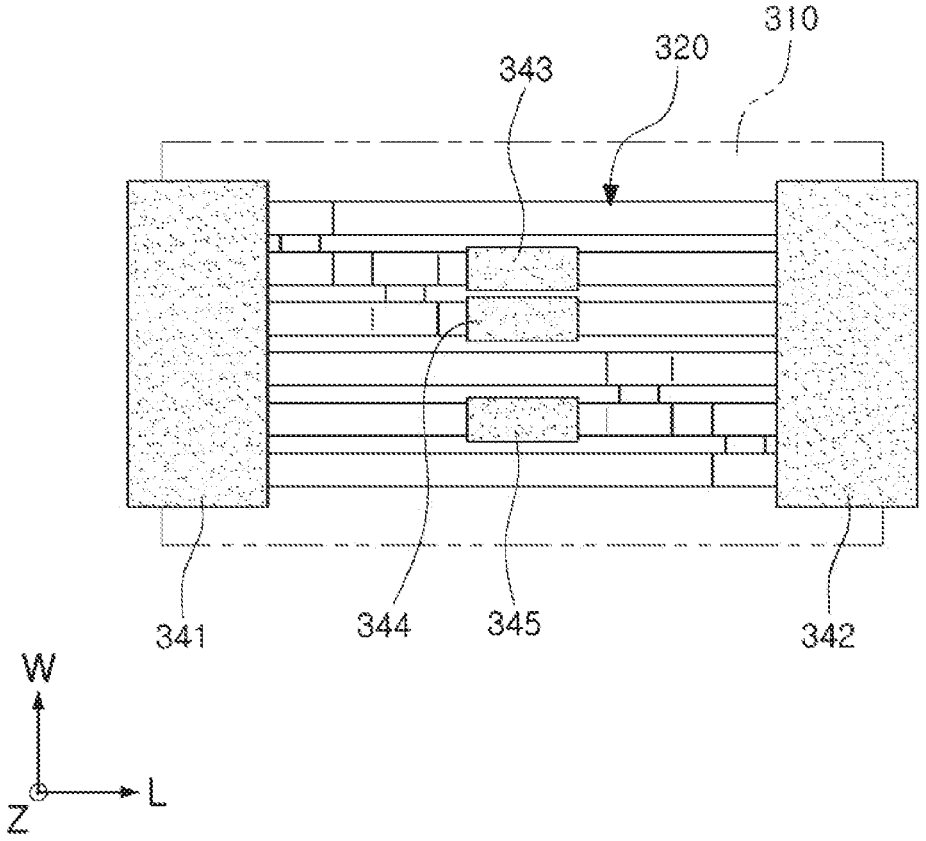
FIG. 12 is a bottom view of the coil component illustrated in FIG. 9.

FIG. 9 is a perspective view illustrating one example of such a coil component. FIG. 10 is a front view of a plurality of body sheets included in the coil component illustrated in FIG. 9. FIG. 11 is a front view of the coil component illustrated in FIG. 9. FIG. 12 is a bottom view of the coil component illustrated in FIG. 9.

Hereinafter, the description overlapping with the description described above with reference to FIGS. 1 through 8 will be omitted for convenience of explanation.

Referring to FIGS. 9 through 12, a coil component 300 may include a body part 310 including an internal coil 320 having the one end and the other end.

A first external electrode 341 may be connected to the one end of the internal coil 320 and a second external coil 342 may be connected to the other end of the internal coil 320.

A third external electrode 343 may be connected to a first point between the one end and the other end of the internal coil 320, and a fourth external electrode 344 may be connected to a second point between the first point and the other end of the internal coil. A fifth external electrode 345 may be connected to a third point between the second point and the other end of the internal coil.

For example, the internal coil 320 may include a plurality of coil patterns 321 to 326 formed on a plurality of body sheets 311 to 316, respectively, one or more via electrodes 331 to 335 penetrating through insulating layers disposed between the plurality of body sheets, a first internal electrode pattern 321*a* connected to the one end of the internal coil and the first external electrode 341, a second internal electrode pattern 326*b* connected to the other end of the internal coil and the second external electrode 342, a third internal electrode pattern 322*c* connected to the first point of the internal coil and the third external electrode 343, a fourth internal electrode pattern 323*c* connected to the second point of the internal coil and the fourth external electrode 344, and a fifth internal electrode pattern 325*c* connected to the third point of the internal coil and the fifth external electrode 345.

In the illustrated example, the first external electrode 341 may be formed on a first side portion of the lower surface of the body part adjacent to the first end surface of the body part—in the illustrated example, a left side portion of the lower surface of the body part adjacent to a left end surface of the body part. The second external electrode 342 may be formed on a second side portion of the lower surface of the body part adjacent to the second end surface of the body part—in the illustrated example, a right side portion of the lower surface of the body part adjacent to a right end surface of the body part. The third external electrode 343 to the fifth external electrode 345 may be formed to be spaced apart from each other in the central portion of the lower surface of the body part.

Some body sheets 312, 313, 314, 315, and 316 may further include dummy patterns 322*a*, 322*b*, 323*a*, 323*b*, 324*a*, 324*b*, 325*a*, 325*b*, and 326*a*. The dummy patterns 322*a*, 322*b*, 323*a*, 323*b*, 324*a*, 324*b*, 325*a*, 325*b*, and 326*a* may be connected to one of the first and second external electrodes 341 and 342 and may not physically contact with the corresponding coil patterns disposed on the same body sheets. However, the dummy patterns may not be formed or may be variously modified according to exemplary embodiments.

Meanwhile, such positions of the external electrodes are illustrative, and the positions of the external electrodes may be thus variously modified. For example, the first external electrode and the third external electrode may be formed to be spaced apart from each other on the first side portion of the lower surface of the body part adjacent to the first end surface of the body part, the second external electrode and the fourth external electrode may be formed to be spaced apart from each other on the second side portion of the lower surface of the body part adjacent to the second end surface of the body part, and the fifth external electrode may be formed on the central portion of the lower surface of the body part.

As set forth above, according to the exemplary embodiments in the present disclosure, the coil component may satisfy the high Q characteristics and may easily adjust the inductance.

In addition, according to an exemplary embodiment in the present disclosure, as three or more connection nodes are provided, various inductances may be adjusted even with one inductor.

While exemplary embodiments have been shown and described above, it will be apparent to those skilled in the art that modifications and variations could be made without departing from the scope of the present invention as defined by the appended claims.

What is claimed is:

1. A coil component comprising:

a body part including an internal coil, the internal coil including one end and another end and a plurality of coil patterns and via electrodes between the plurality of coil patterns, the plurality of coil patterns and the via electrodes being connected in series between the one end and the another end;

a first external electrode connected to the one end of the internal coil;

a second external electrode connected to the another end of the internal coil; and a third external electrode connected to a first coil pattern of the plurality of coil patterns.

2. The coil component of claim 1, wherein the internal coil further includes:

a first internal electrode pattern connected to the one end of the internal coil and the first external electrode;

a second internal electrode pattern connected to the another end of the internal coil and the second external electrode; and a third internal electrode pattern connected to the first coil pattern and the third external electrode, and the plurality of coil patterns are disposed on a plurality of body sheets, respectively.

3. The coil component of claim 2, wherein the body part has a hexahedral shape including an upper surface and a lower surface opposing each other in a thickness direction thereof, and a first end surface and a second end surface opposing each other in a length direction thereof, the first external electrode is disposed on a first side portion of the lower surface of the body part adjacent to the first end surface of the body part, and the second external electrode is disposed on a second side portion of the lower surface of the body part adjacent to the second end surface of the body part.

4. The coil component of claim 3, wherein the third internal electrode pattern is disposed in the body part and exposed from a central portion of the lower surface of the body part between the first side portion and the second side portion of the lower surface of the body part.

5. The coil component of claim 2, further comprising a fourth external electrode connected to a second coil pattern of the plurality of coil patterns between the first coil pattern and the another end of the internal coil.

6. The coil component of claim 5, wherein the internal coil further includes a fourth internal electrode pattern connected to the second coil pattern and the fourth external electrode.

7. The coil component of claim 5, wherein the body part has a hexahedral shape including an upper surface and a lower surface opposing each other in a thickness direction thereof, and a first end surface and a second end surface opposing each other in a length direction thereof, the first external electrode and the third external electrode are spaced apart from each other on a first side portion of the lower surface of the body part adjacent to the first end surface of the body, and the second external electrode and the fourth external electrode are spaced apart from each other on a second side portion of the lower surface of the body part adjacent to the second end surface of the body part.

8. The coil component of claim 5, further comprising a fifth external electrode connected to a third coil pattern of the plurality of coil patterns between the second coil pattern and the another end of the internal coil.

9. The coil component of claim 8, wherein the internal coil further includes a fifth internal electrode pattern connected to the third coil pattern and the fifth external electrode.

10. The coil component of claim 8, wherein the body part has a hexahedral shape including an upper surface and a lower surface opposing each other in a thickness direction thereof, and a first end surface and a second end surface opposing each other in a length direction thereof, the first external electrode is disposed on a first side portion of the lower surface of the body part adjacent to the first end surface of the body part, the second external electrode is disposed on a second side portion of the lower surface of the body part adjacent to the second end surface of the body part, and the third external electrode to the fifth external electrode disposed on a central portion of the lower surface of the body part between the first side portion and the second side portion of the lower surface of the body part, are spaced apart from each other.

11. A coil component comprising:

a body part including an internal coil including a plurality of coil patterns disposed on a plurality of body sheets, respectively, and one or more via electrodes penetrating through insulating layers disposed between the plurality of body sheets;

a first end electrode connected to one end of the internal coil;

a second end electrode connected to another end of the internal coil; and at least one intermediate node external electrode connected to at least one of the plurality of coil patterns, wherein the plurality of coil patterns and the one or more via electrodes are connected in series between the one end and the another end of the internal coil.

12. The coil component of claim 11, wherein the body part has a hexahedral shape including an upper surface and a lower surface opposing each other in a thickness direction thereof, and a first end surface and a second end surface opposing each other in a length direction thereof, the first end electrode is disposed on a first side portion of the lower surface of the body part adjacent to the first end surface of the body part, and the second end electrode is disposed on a second side portion of the lower surface of the body part adjacent to the end surface of the body part.

13. The coil component of claim 12, wherein the at least one intermediate node external electrode is disposed on a central portion of the lower surface of the body part between the first side portion and the second side portion of the lower surface of the body part.

14. The coil component of claim 12, wherein the at least one intermediate node external electrode includes:

a first intermediate node external electrode spaced apart from the first end electrode, on the first side portion of the lower surface of the body part; and a second intermediate node external electrode spaced apart from the second end electrode, on the second side portion of the lower surface of the body part.

15. The coil component of claim 14, wherein the at least one intermediate node external electrode further includes a third intermediate node external electrode disposed on a central portion of the lower surface of the body part between the first side portion and the second side portion of the lower surface of the body part.

16. A coil component comprising:

a body part including an internal coil including one end and another end;

a first external electrode connected to the one end of the internal coil;

a second external electrode connected to the another end of the internal coil;

a third external electrode connected to a first point between the one end of the internal coil and the another end of the internal coil;

a fourth external electrode connected to a second point between the first point and the another end of the internal coil; and a fifth external electrode connected to a third point between the second point and the another end of the internal coil, wherein the internal coil includes:

a plurality of coil patterns disposed on a plurality of body sheets, respectively;

one or more via electrodes penetrating through an insulating layer included in the plurality of body sheets;

a first internal electrode pattern connected to the one end of the internal coil and the first external electrode;

a second internal electrode pattern connected to the another end of the internal coil and the second external electrode; and a third internal electrode pattern connected to the first point of the internal coil and the third external electrode.

17. The coil component of claim 16, wherein the internal coil further includes a fifth internal electrode pattern connected to the third point of the internal coil and the fifth external electrode.

18. The coil component of claim 16, wherein the body part has a hexahedral shape including an upper surface and a lower surface opposing each other in a thickness direction thereof, and a first end surface and a second end surface opposing each other in a length direction thereof, the first external electrode is disposed on a first side portion of the lower surface of the body part adjacent to the first end surface of the body part, the second external electrode is disposed on a second side portion of the lower surface of the body part adjacent to the second end surface of the body part, and the third external electrode to the fifth external electrode disposed on a central portion of the lower surface of the body part between the first side portion and the second side portion of the lower surface of the body part, are spaced apart from each other.

* * * * *